United States Patent [19]

Smith

[11] Patent Number: 4,596,228

[45] Date of Patent: Jun. 24, 1986

[54] CABLE SEPARATOR FOR COMPOUND BOWS

[76] Inventor: Max D. Smith, R.R. 7, Box 88B, Orchard Rd., Evansville, Ind. 47712

[21] Appl. No.: 492,122

[22] Filed: May 6, 1983

[51] Int. Cl.[4] ..... F41B 5/00

[52] U.S. Cl. ..... 124/23 R; 124/88; 124/DIG. 1

[58] Field of Search ..... 124/24 R, 23 R, 88, 124/86, 90, DIG. 1

[56] References Cited

U.S. PATENT DOCUMENTS 4,332,231 6/1982 Napier et al. ..... 124/88 X 4,452,222 6/1984 Quartino ..... 124/88

OTHER PUBLICATIONS

"Hunter"-Bow & Arrow Magazine, Oct. 1982, p. 10.

"Jennings Pylon Cable Guard"-Archery Magazine, Aug. 1978, p. 24.

*Primary Examiner*—Richard C. Pinkham

*Assistant Examiner*—Benjamin Layno

[57] ABSTRACT

A cable separator for a compound bow is disclosed which includes a body defining an aperture within which a cable guard on the bow is slidably received. A first inside cable surface having a groove facing away from the cable guard is defined on one side of the guard. An L-shaped flange extends on the other side of the cable guard and defines a cable surface for reception thereagainst of the other inside cable of the bow. The cable separator may be mounted to an assembled bow and the inside cables positioned therewith, without the necessity of unstringing the bow.

16 Claims, 7 Drawing Figures

CABLE SEPARATOR FOR COMPOUND BOWS

BACKGROUND OF THE INVENTION

1. Field of the Invention

The present invention relates to the field of compound bows, and more particularly to a device for keeping the inside cables of such a bow separate from one another.

2. Description of the Prior Art

Compound bows have been in existence for some time, and their general construction and operation is well known. In certain designs, the compound bows include a cable which spans between the bow tips to define the center, arrow-receiving portion. This cable then extends over pulleys at each of the bow tips, and the two ends cross to the opposite limb at which point they are attached.

The latter two cable portions, referred to herein as the inside cables, normally lie in the plane of the center portion of the cable, and would thereby interfere with the arrow as it is being shot. Consequently, some bows have included a cable guard which typically comprises a rod which is affixed to the bow and extends toward the archer. An example of a cable guard is shown in U.S. Pat. No. 4,332,231, issued to Napier et al. on June 1, 1982. The guard is positioned to restrain the inside cables to one side of the center line of the bow, thereby moving the inside cables out of the way of the arrow.

A problem which has been encountered with compound bows, and particularly with those including a cable guard. has been the generation of noise caused by the rubbing together of the two inside cables. Since the inside cables cross one another in extending between opposite bow limbs, they necessarily contact each other under normal conditions. The cable guard heightens the contact since both inside cables lay upon the guard. The noise which is thereby generated can be a considerable problem. especially if the bow is being used for hunting purposes and this noise can be detected by the game birds or animals.

To overcome this problem, certain devices have been employed in the prior art to minimize or muffle the noise generated by the inside cables. Some of these devices are directed more to facilitating the sliding action of the inside cables relative the cable guard. Others include means for separating the cables at the cable guard, the cables being positioned in a plane, and being parallel but spaced apart a short distance.

One such design is a device available under the designation "CABLE POSITIONER WITH SIDE MOUNT" from Bear Archery, a subsidiary of Kidde, Inc. located in Gainesville, Fla. This device is a small plastic item which has three rings mounted to a base. The rings have aligned apertures in which the cable guard is received. The two inside cables are received at the base of the openings between adjacent rings and retained therein by the cable guard.

A related design is one which comprises a small plastic guide which has a cylindrical depression within which the cable guard is received. Opposite the depression are a pair of slots extending transverse of the depression and receiving the inside cables therein. The guide is held against the cable guard by the pressure of the inside cables, and is free to slide along the guard with the cables. A third design similar to the "CABLE POSITIONER" from Bear Archery comprises simply a cylindrical sleeve which fits over the cable guard and includes a pair of transverse holes within which the inside cables are received.

A disadvantage of the described cable separators is that they do not fully separate the cables for their full extend. These devices perhaps serve a more direct purpose of facilitating movement of the inside cables relative the cable guard, and do not fully serve the purpose of separating the cables to eliminate contact noise. As a result, an additional device has been proposed, to be used in conjunction with the described separators, to further ensure separation of the cables. Such a device is available under the designation "BEAR 'NEET' CABLE SILENCER" from Bear Archery, Inc. This device has an S-shaped cross section and each of the two inside cables is received in one of the opposed curves. This device may be placed anywhere along the inside cables and thereby is positionable at the location where contact between the cables would otherwise occur. However, this results in the use of two separate pieces being used to accomplish the desired result of lessening cable noise.

SUMMARY OF THE INVENTION

Briefly describing one aspect of the present invention there is provided a cable separator for compound bows which comprises a unitary member including an aperture within which the cable guard of the bow is received. The member includes cable-receiving apertures, slots or grooves within the inside cables are received and are thereby separated from one another along both the horizontal and transverse axes of the bow.

It is an object of the present invention to provide a cable separator for a compound bow, and particularly for a bow having a cable guard mounted thereon.

Another object of the present invention is to provide a cable separator which is easily manufactured and which is readily installed onto the compound bow, particularly without the requirement that the bow be disassembled to thread the cables into the separator.

It is a further object of the present invention to provide a cable separator which fully separates the inside cables of a compound how with a single, unitary element. rather than requiring two separate pieces to accomplish the desired separation.

Another object of the present invention is to provide a cable separator which is simple and convenient to use, and which may be readily installed or removed on a variety of existing compound bow designs.

Further objects and advantages of the present invention will become apparent from the description of the preferred embodiment which follows.

DESCRIPTION OF THE PREFERRED EMBODIMENT

Figure 1:
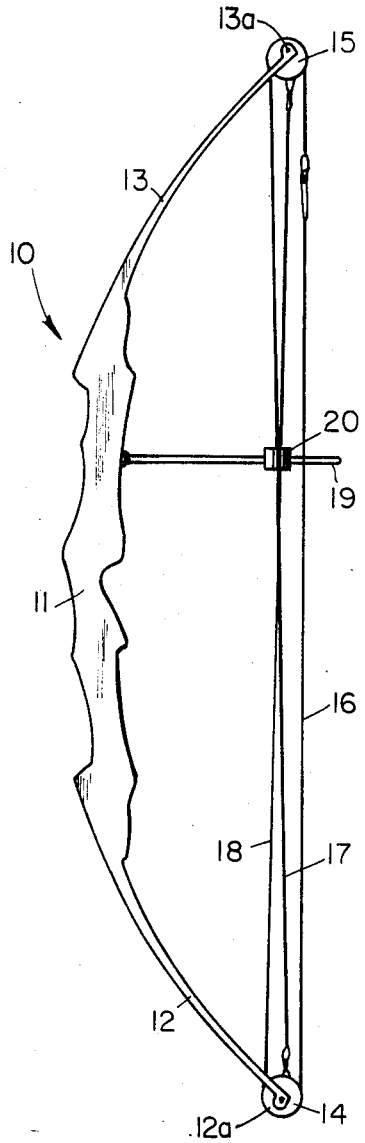
FIG. 1 is a schematic view of a compound bow having a cable guard mounted thereto and including a cable separator constructed in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to the drawings there is shown a cable separator and compound bow constructed in accordance with the present invention. A schematic view is presented in FIG. 1 and shows a compound bow 10 having a handle portion 11 and a pair of limbs 12 and 13, each having a tip end 12*a* and 13*a*. At the tip ends 12*a* and 13*a* of the limbs are pulleys 14 and 15 which operate in known fashion to provide a mechanical advantage for the bow by an eccentric mounting of the pulleys. A cable includes a central, arrow-receiving portion 16 which extends between the pulleys mounted on the tip ends 12*a* and 13*a* of the bow limbs. The central cable portion connects with inside cables 17 and 18 which extend from the pulleys to the opposite bow limbs.

The bow includes a cable guard 19 which extends rearwardly from the handle portion 11. The guard extends adjacent the inside cables, and may include an offset or the like to urge the inside cables to one side, out of line with the central cable portion 16. Mounted to the cable guard is a cable separator 20 as provided by the present invention. This separator facilitates the sliding of the inside cables relative the cable guard, and also substantially eliminates noise which might otherwise occur due to the vibration and touching together of the inside cables.

Figure 2:
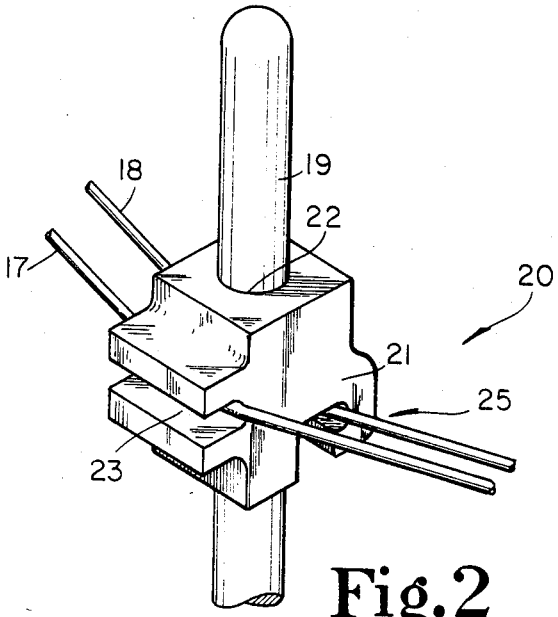
FIG. 2 is a perspective view of a preferred embodiment of the cable separator of the present invention.
Figure 3:
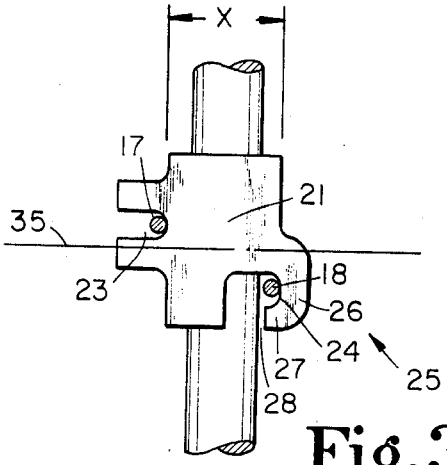
FIG. 3 is a side, elevational view of the cable separator of FIG. 2.
Figure 4:
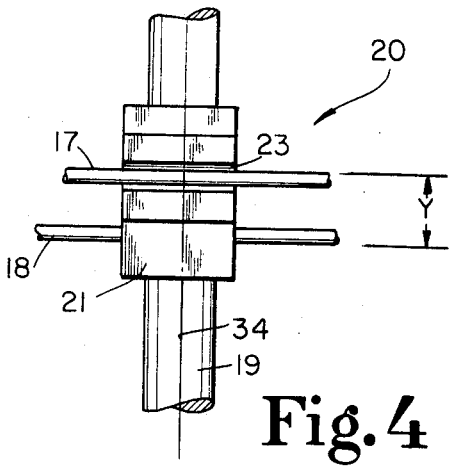
FIG. 4 is a front, elevational view of the cable separator of FIG. 2.

A preferred embodiment of the cable separator 20 is shown in FIGS. 2–4. The separator includes a body member 21 which defines a guard surface 22 against which the cable guard is slidably received. It will be appreciated that as the bow limbs flex upon pulling back the arrow cable 16, the inside cables will tend to move rearwardly relative the cable guard. The separator 20 is therefore provided with a surface that engages the cable guard and permits ready sliding of the separator, with the received inside cables, relative the guard. In the preferred embodiment, the body member defines a central, guard-receiving aperture which defines the guard surface and in which the cable guard is received.

The cable separator 20 defines a first cable surface for reception thereagainst of a first of the inside cables, such as cable 17. The first cable surface preferably comprises a groove 23 which extends transverse of the guard aperture and faces away from the guard aperture. As shown, the first inside cable 17 may thereby be moved to and from the cable surface while the cable separator remains in place upon the cable guard.

The cable separator of the present invention also defines a second cable surface 24 for reception thereagainst of the second of the inside cables, such as cable 18. The second cable surface preferably comprises a groove extending transverse of the guard aperture, and therefore of the cable guard, and faces toward the guard aperture and guard. In this configuration, the first and second cable surfaces are positioned on opposite sides of the cable guard, and the inside cables are consequently extended on opposite sides of the cable guard.

The separator preferably includes an L-shaped flange 25 having a first leg 26 extending outwardly of the body member adjacent one side of the guard aperture. The second leg 27 of the flange extends toward the guard aperture, and therefore toward the cable guard when conceived within the aperture. As is apparent particularly in FIG. 3, the second cable surface is thereby defined by the base of the slot formed between the L-shaped flange and the body member.

In a first embodiment, the second leg 27 of the flange 25 terminates short of the guard aperture, as shown particularly in FIGS. 2–4. In particular, the second leg is spaced apart from the guard aperture and is spaced from the cable guard when received within the guard aperture. This permits the second inside cable to be moved through the space 28 between the cable guard and the second leg and into the second cable surface defined by the L-shaped flange. More particularly, the inside cable 18 may be moved into and out of the groove 24 while the cable separator remains in place upon the cable guard.

Figure 5:
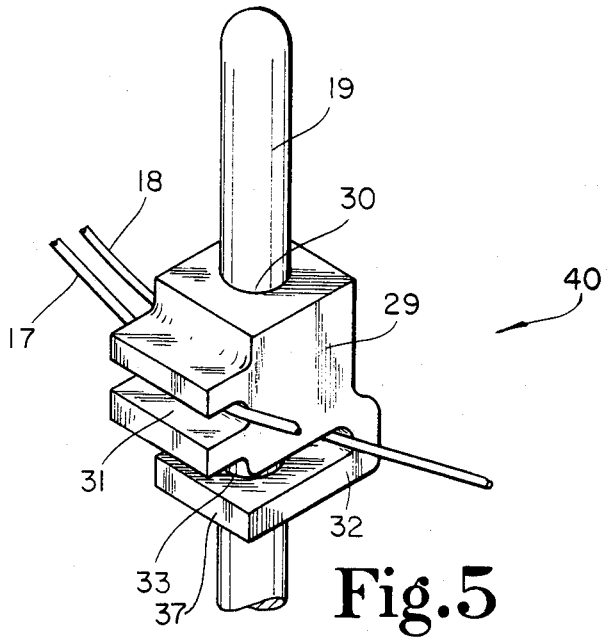
FIG. 5 is a perspective view of an alternate embodiment of the present invention.
Figure 6:
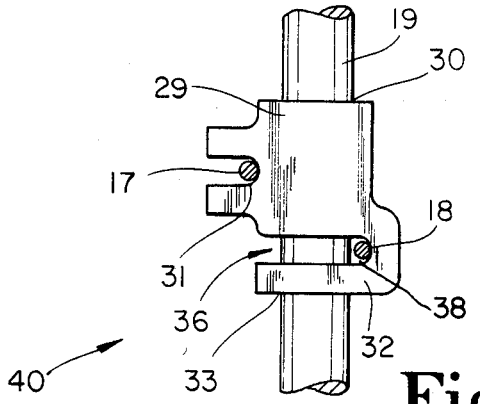
FIG. 6 is a side, elevational view of the cable separator of FIG. 5.
Figure 7:
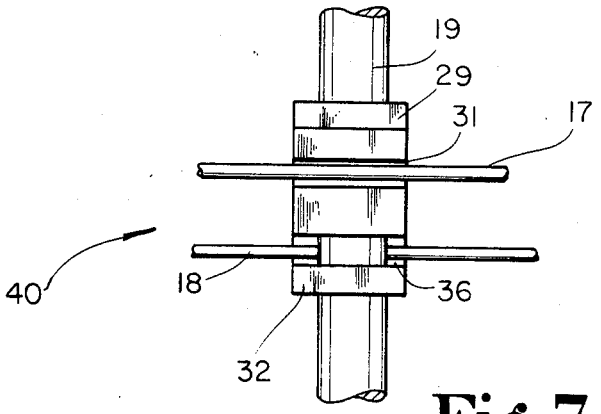
FIG. 7 is a front, elevational view of the cable separator of FIG. 5.

A second embodiment is shown in FIGS. 5–7. In this embodiment, the second leg of the L-shaped flange extends beyond the central, guard aperture of the body member. More particularly, there is provided a cable separator 40 which includes a body member 29 defining a central, guard aperture 30. The body member defines a first cable surface 31 which may be identical with the surface 23 previously described.

The cable separator 40 also includes an L-shaped flange 32 which extends from the body member, defining a slot 36. However, in this embodiment the flange includes a second leg 37 which extends beyond the central, guard aperture of the body member and defines a second guard-receiving aperture 33 aligned with the aperture 30 of the body member. A second cable-receiving surface 38 is thereby defined by the L-shaped flange 32 and the body member 29.

In contrast to the previous embodiment, the second inside cable cannot be moved into and out of the cable surface 38 with the separator remaining in place on the cable guard. However, the cable is movable to the second cable surface prior to placement of the separator over the cable guard. The inside cable is then retained adjacent the cable surface by the cable guard extending through the aligned guard apertures of the body member and the second leg of the L-shaped flange. As for the first embodiment, the first cable 17 may be freely moved to and from the first cable surface with the separator remaining in place upon the cable guard.

The compound bow includes a longitudinal axis which extends parallel with the central cable portion 16. The bow further has a horizontal axis 34 (FIG. 3) extending perpendicular to the central cable and in the plane of the bow limbs, and a transverse axis 35 (FIG. 3) extending perpendicular to both the central cable and the plane of the bow limbs. As shown for example in FIGS. 3 and 4, the cable separator of the present invention separates the two inside cables along both the horizontal and transverse axes of the bow. The horizontal spacing, designated as a distance "Y" in FIG. 4, may be varied by location of the cable surfaces 23 and 24. Similarly, the transverse spacing, designated as a distance "X" in FIG. 3, may be varied as desired.

As a result of the horizontal and transverse displacement of the inside cables, the separation of the cables is effectuated. The cables remain separate throughout their length while at rest and when the bow is shot, and the noise associated therewith is therefore virtually eliminated. Desirably, the cable separator of the present invention accomplishes a complete separation by use of only a single element mounted to the cable guard. Movement of the inside cables relative the guard is also enhanced, with a resulting reduction in cable wear. Further, the cable separator may be applied after the bow is strung, and after the cable ends have been clinched for the various fittings used in assembly of the cable with the bow.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What I claim is:

1. A combination of a compound bow and cable separator, comprising:

a compound bow assembly including:

a handle portion;

a pair of flexible bow limbs, each bow limb having a tip end, said bow limbs being attached to said handle portion in a plane including said bow limbs;

a plurality of pulleys rotatably mounted to said tip ends of said bow limbs;

a central cable extending between said pulleys;

a first inside cable extending between said bow limbs;

a second inside cable extending between said bow limbs;

a cable guard attached to said handle portion and extending rearwardly from said handle portion adjacent said first inside cable and said second inside cable;

a horizontal axis extending perpendicular to said central cable and in the plane including said bow limbs; and, a transverse axis extending perpendicular to both said central cable and the plane including said bow limbs; and, a cable separator including:

a body member defining a guard surface against which said cable guard is slidably received;

said body member defining a first cable surface for reception thereagainst of said first inside cable;

said body member defining a second cable surface for reception thereagainst of said second inside cable;

positioning means, located in said body member, for positioning said first cable surface and said second cable surface so that when said first inside cable and said second inside cable are received in said first cable surface and said second cable surface said first inside cable and said second inside cable are spaced apart along both said horizontal axis and said transverse axis of said compound bow assembly.

2. The apparatus of claim 1 in which the body member includes a central, first guard aperture defining the guard surface and in which the cable guard is slidably received.

3. The apparatus of claim 2 in which the first cable surface and second cable surface are located on opposite sides of the first guard aperture, to position first inside cable and second inside cable on opposite sides of the cable guard.

4. The apparatus of claim 3 in which the first cable surfaces is a groove extending transverse of the first guard aperture and facing away from the first guard aperture.

5. The apparatus of claim 3 in which the second cable surfaces is a groove extending transverse of the first guard aperture and facing toward the first guard aperture.

6. The apparatus of claim 5 in which the first cable surface is a groove extending transverse of the first guard aperture and facing away from the first guard aperture.

7. The apparatus of claim 3 and which includes an L-shaped flange having a first leg extending outwardly of said body member adjacent one side of the first guard aperture and a second leg extending toward the first guard aperture, the L-shaped flange together with said body member defining the second cable surface.

8. The apparatus of claim 7 in which the second leg terminates short of the first guard aperture.

9. The apparatus of claim 8 in which the second leg is spaced from the first guard aperture and is spaced from the cable guard when the cable guard is slidably received within the first guard aperture to permit the second inside cable to be moved through the space between the cable guard and the second leg and into the second cable surface defined by the L-shaped flange.

10. The apparatus of claim 9 in which the first cable surface is a groove extending transverse of the first guard aperture and facing away from the first guard aperture.

11. The apparatus of claim 9 in which the second cable surface is a groove extending transverse of the first guard aperture and facing toward the first guard aperture.

12. The apparatus of claim 11 in which the first cable surface is a groove extending transverse of the first guard aperture and facing away from the first guard aperture.

13. The apparatus of claim 7 in which the second leg extends beyond the first guard aperture and defines a second guard aperture aligned with first guard aperture of said body member, the second inside cable being movable to the second cable surface defined by the L-shaped flange prior to placement of said separator over the cable guard, and the second inside cable being retained adjacent the second cable surface by the cable guard extending through the aligned first guard aperture and second guard aperture of said body member and the second leg of the L-shaped flange.

14. The apparatus of claim 13 in which the first cable surface is a groove extending transverse of the first guard aperture and facing away from the first guard aperture.

15. The apparatus of claim 13 in which the second cable surface is a groove extending transverse of the first guard aperture and facing toward the first guard aperture.

16. The apparatus of claim 15 in which the first cable surface is a groove extending transverse of the first guard aperture and facing away from the first guard aperture.

* * * * *